US010140801B2

(12) United States Patent
Norris

(10) Patent No.: US 10,140,801 B2
(45) Date of Patent: Nov. 27, 2018

(54) CONTROLLING DISPENSING OF ITEMS

(71) Applicant: James Marcus Norris, Middlesex (GB)

(72) Inventor: James Marcus Norris, Middlesex (GB)

( * ) Notice: Subject to any disclaimer, the term of this patent is extended or adjusted under 35 U.S.C. 154(b) by 0 days.

(21) Appl. No.: 14/045,409

(22) Filed: Oct. 3, 2013

(65) Prior Publication Data

US 2014/0172161 A1 Jun. 19, 2014

(30) Foreign Application Priority Data

Oct. 3, 2012 (GB) ..... 1217692.1

(51) Int. Cl.
*G07F 11/00* (2006.01)
*G07F 11/62* (2006.01)

(52) U.S. Cl.
CPC ..... *G07F 11/002* (2013.01); *G07F 11/005* (2013.01); *G07F 11/62* (2013.01)

(58) Field of Classification Search
CPC ..... G07F 11/002; G07F 11/005; G07F 11/62
USPC ..... 700/231–244
See application file for complete search history.

(56) References Cited

U.S. PATENT DOCUMENTS 5,638,985 A 6/1997 Fitzgerald et al.
5,661,978 A * 9/1997 Holmes ..... F25B 21/02 312/209
5,927,540 A * 7/1999 Godlewski ..... E05B 65/46 221/103
6,109,774 A * 8/2000 Holmes ..... G07F 11/62 221/12
6,116,461 A * 9/2000 Broadfield ..... A61G 12/001 206/443
7,426,425 B2 * 9/2008 Meek et al. ..... 700/237
7,657,344 B2 * 2/2010 Holmes ..... A47B 88/00 312/215
8,019,470 B2 * 9/2011 Meek, Jr. ..... E05B 47/0002 700/232
8,197,017 B2 * 6/2012 Rahilly ..... E05B 65/0003 312/215

(Continued)

FOREIGN PATENT DOCUMENTS

WO WO 99/30248 A1 6/1999
WO WO 2007/029236 A2 3/2007
WO WO 2007/029236 A3 3/2007

OTHER PUBLICATIONS

Patents Act 1977: Examination Report under Section 18(3), dated Mar. 7, 2016, issued in corresponding GB Application No. GB1317510.4 (3 pgs.).

(Continued)

*Primary Examiner* — Michael Collins
(74) *Attorney, Agent, or Firm* — Nixon & Vanderhye P.C.

(57) ABSTRACT

A device for controlling dispensing of items, includes a frame 34; at least one drawer 16 slidably mounted to the frame, the drawer having a plurality of storage sections 21; a plurality of access panels 3, each associated with one of the storage sections; control means operable to control movement of each of the access panels 3 relative to the associated drawer 16 (such as by controlling an actuator rod 210 and a latch 50) so that, when the drawer 16 is opened, the access panel 3 is either in a first mode which prevents access to its associated storage section 21 or in a second mode which allows access to its associate storage section 21.

10 Claims, 10 Drawing Sheets

(56) References Cited

U.S. PATENT DOCUMENTS

| | | | | |
|---|---|---|---|---|
| 8,517,215 | B2 * | 8/2013 | Shafir | A47F 1/00 221/124 |
| 8,554,364 | B2 * | 10/2013 | Holmes et al. | 700/236 |
| 8,700,210 | B2 * | 4/2014 | Bufalini et al. | 700/242 |
| 8,700,211 | B2 * | 4/2014 | Shoenfeld | A47B 88/20 221/151 |
| 8,744,621 | B2 * | 6/2014 | Michael | E05B 47/00 221/122 |
| 9,121,197 | B2 * | 9/2015 | Michael | E05B 47/00 |
| 2003/0201697 | A1 * | 10/2003 | Richardson | A47B 81/00 312/209 |
| 2004/0108795 | A1 | 6/2004 | Meek, Jr. et al. | |
| 2005/0113970 | A1 | 5/2005 | Holmes et al. | |
| 2009/0055018 | A1 * | 2/2009 | Meek et al. | 700/237 |
| 2009/0224638 | A1 * | 9/2009 | Weber | A47B 67/02 312/209 |
| 2011/0196538 | A1 * | 8/2011 | Michael | E05B 47/00 700/275 |

OTHER PUBLICATIONS

Patents Act 1977: Search Report under Section 17(5), dated Mar. 25, 2014, issued in corresponding GB Application No. GB1317510.4 (3 pgs.).

* cited by examiner

CONTROLLING DISPENSING OF ITEMS

This application claims priority of British Patent Application No. 1217692.1, filed 3 Oct. 2012, the entire contents of each of which are hereby incorporated by reference.

TECHNICAL FIELD

The present invention relates to a device for controlling the dispensing of items, and more particularly, but not exclusively, to the dispensing of garments, such as medical "scrubs".

BACKGROUND TO THE INVENTION

Scrub garments are uniforms typically worn by doctors, nurses, and other medical workers in such places as operating theatres, and are used to reduce the chance of infection to patients from the medical staff own clothes. Scrubs usually consist of a top piece and a bottom piece, thus comprising a 'set'. Tops and bottoms are stocked in various sizes for individual wearers. Typically scrubs are issued/dispensed as a set.

When scrubs become soiled they are returned to a soiled basket or container whereby they are returned to laundry for washing. Once cleaned they are made available for reuse. Periodically scrub uniforms are disposed of and replaced due to the fact they become worn from repeated wear and from the stresses of repeated cleaning and repeat sterilising.

Hospitals and medical centres make scrubs available to their staff as part of their job function, and typically each user is only permitted to have access to a limited number of scrub uniforms at any time. Typically users tend to abuse this restriction by storing scrubs in personal lockers to ensure they can obtain further sets without delay or having to gain further authorisation. It is not uncommon for scrubs to be taken home or worn home. The hoarding of extra scrubs and the improper use of scrubs causes problems as inventories need to be replaced on a regular basis, and low stocks can cause unavailability of scrubs when they are most required.

The stock of scrubs can be further compromised by careless handling by users. Often scrubs are just left available on shelves or in free-access lockers making the stocks vulnerable to abuse, e.g. scrubs can be pulled off shelves dislodging others and causing them to fall to the floor to then become contaminated and subsequently requiring unnecessary rewashing. The abuse of scrub usage can be expensive and hospital scrub replacement budgets can rise significantly due to all these problems.

Some hospitals enforce a manual uniform service, such that a uniform room is managed by staff on a daily basis. Users of uniforms and scrubs are then required to sign for their uniforms and return them in order to obtain fresh replacement sets. This method works to some degree but there is a cost overhead mainly due to the fact larger hospitals typically need multiple rooms managed on site, and due to the fact scrubs are required 24-7 the uniform rooms need constant staffing around the clock, significantly increasing the cost of managing the service.

As an alternative, mechanical dispensers have been proposed. Due to the fact scrub dispensers need to be located close to operating room areas and corridors it is important to ensure the machine is as compact and small as possible and with adequate stocks of scrub-wear to satisfy demand. Also, due to the fact staff then become reliant on the dispensers to issue scrubs, the system must be reliable and easily restocked with minimal down time.

The problem of automatic dispensing of scrub items is particularly difficult due to the nature of the folded fabric. Since the folded fabric items are not of rigid shape and size they cannot be dispensed through other known machines types such as those dispensing cans, bottles, video CDs or cigarette packets. The scrub item cannot easily be manipulated and transported within the machine, like the above described items.

Also, known scrub dispensing systems currently available suffer from various other shortcomings.

For example, some machines store scrubs on shelves, or in stacks, such that, when dispensing, the scrub is either pushed off the shelf automatically or allowed to drop down a slope to an open hatch door in the base of the unit. These systems can suffer from jamming, and they tend to be unnecessarily big due to extra space required for the slope or chute.

Some machines operate on a rotary basis, where a drum containing a number of compartments, on a number of levels, which is then rotated around as a whole until the chosen scrub article is positioned behind a locked door. The door is then unlocked for issue. These systems tend to be big units as they must allow for a large rotating drum which also makes them somewhat more complicated and expensive.

Some machines, such of described in U.S. Pat. No. 5,638,985, are similar to mailbox pigeon-holes where an array of compartments has a door in front restricting user access. The nature of having multiple doors makes the unit particularly complex, expensive and vulnerable to abuse where users can damage the fragile small doors.

The described embodiment aims to improve over these known designs and provide a system that is both cost-effective, easy to maintain and of a compact size.

SUMMARY OF THE INVENTION

According to a first aspect of the invention, there is provided a device for controlling dispensing of items, including: a frame; at least one drawer slidably mounted for movement with respect to the frame, the drawer having a plurality of storage sections; a plurality of access panels, each associated with one of the storage sections; control means operable to control movement of each of the access panels relative to the associated drawer so that, when the drawer is opened, the access panel is either in a first mode which prevents access to its associated storage section or in a second mode which allows access to its associate storage section.

Each storage section may comprise a preferably rigid base and a plurality of preferably rigid walls surrounding the base, the storage section being accessed through a top opening. The top opening is selectively closed by the access panel.

The device may include locking means, such as a latch operable to selectively allow the drawer to be opened. The locking means is preferably controlled by the control means.

The drawer may be arranged for manual movement by a user. This is simpler to engineer than automated/motorised movement.

An access panel coupling means may be associated with each of said access panels and operable in a first position to (directly or indirectly) couple the access panel to the frame so that when the drawer is opened movement of the access panel is constrained by the coupling means and the access panel enters the second mode allowing access to the storage section.

The device may comprise latch means operable in a first position to facilitate movement of the drawer relative to the access panel.

The coupling means may be operable in a second position to de-couple the access panel from the frame so that when the drawer is opened the access panel in the first mode moves with the drawer so preventing access to the storage section.

The latch means may be operable in a second position to couple the access panel to the drawer.

The coupling means in a second embodiment may comprise a linearly reciprocating member (e.g. an actuating rod coupled to the frame) operable in the first position to couple the access panel with respect to the frame by engagement of the linearly reciprocating member with the access panel, and wherein the latch means comprises a latch member moveable into its first position by the linearly reciprocating member.

In a first embodiment an access panel latch means may be associated with each of said access panels and operable in a first position to mechanically couple the access panel to the frame and to facilitate movement of the drawer relative to the access panel so that when the drawer is opened movement of the access panel is constrained by the latch means and the access panel enters the second mode allowing access to the storage section. In the embodiment the latch means is controlled by the control means.

In a first embodiment the access panel latch means may be operable in a second position to mechanically de-couple the access panel from the frame and to mechanically couple the access panel to the drawer so that when the drawer is opened the access panel in the first mode moves with the drawer so preventing access to the storage section.

The control means is preferably operable to retrieve data relating to a characteristic of an item stored in each of the storage sections (such as the size of the items). The control means may further be operable to receive data relating to an item required to be dispensed, to identify in which of the storage sections such an item is stored and to operate the access panel of the storage section containing that item in the second mode to allow access to that item. For example, the control means receives a request for a particular size of item and can then identify the relevant storage section containing that size of item to dispense the item. The data relating to the item to be dispensed may be provided by the control means identifying the potential user of the item (e.g. by reading a user ID card).

A system may be provided that includes the main device defined above in combination with an auxiliary device which includes a frame (like that of the main device), at least one drawer (like that of the main device) having a plurality of storage sections (like those of the main device), and a plurality of access panels (like those of the main device), wherein the control means controls the movement of each of the access panels of the auxiliary device.

In one aspect the invention provides a vending machine for dispensing items and articles such as scrub-wear garments and other small uniform articles such as chefs' hats, aprons, accessories, small towels etc.

The machine may define a number of drawers vertically stacked, so that each drawer can be accessed by pulling the drawer forward to open, when unlocked.

In the embodiment, each drawer may define a number of separate storage sections/divisions (side-by-side) such that a number of items can be stored within each drawer. Each division is fitted with a sliding back-and-forth access panel/cover which is either in the forward position locked blocking access to the division (first mode), or, withdrawn backwards allowing access to the division when the drawer is open (second mode).

It is preferred that only one drawer will be unlocked at any one time.

Any number of storage sections/divisions within the unlocked drawer can be made available for access. It is expected that in normal operation that only one storage sections/division will be opened at any one time unless the unit is placed into a 'clean' or 'refill' mode in which case many or all storage sections/divisions will be uncovered for access.

A minimum system may consist of just a Master unit. The Master unit may contain 8 drawers each with 8 storage sections/compartments, thus 64 scrub-wear sets can be stored for issue in this unit. The Master unit may include a user control panel with the LCD display and ID-card reader.

The user control panel may comprise an ID-Card reader (or biometric reader), an LCD display, and a number of programmable keys—keys which can be used either for selecting a scrub-wear size or for confirming actions or instructions as necessary. Users may be directed to press a particular key if necessary.

To expand the system capacity additional Auxiliary units can be connected to the Master unit to increase the number of storage sections/compartments, and thus the number of scrub-wear sets stored. Each Auxiliary unit may contain 9 drawers each with 8 storage sections/compartments (=72 scrub sets). A number of systems could be on site sharing a single database.

The system is typically configured to store a range of sized items in the drawers, and will be initially refilled and programmed to contain a range of various sizes. The system database may contain the range of sizes in each unit thus it can direct the user to the correct drawer and storage section/compartment which contains their preferred size. Thus, each unit and each drawer can be divided-up to store a range of different sizes throughout the entire system.

The unit may wait in an 'idle' state displaying a 'swipe card' message on the LCD display awaiting a user.

In the idle state all drawers remain locked—e.g. in a first embodiment a drawer latch is engaged over a drawer latch pin thus the drawer cannot be pulled forward open. There may be a latch and drawer latch pin on both sides of the drawer. The latch may be biased in the latched position by virtue of a spring. When it is required to open the drawer for access a solenoid or other device may energise and pull the latch lever upwards around a pivot point. The latch is then rotated free of the drawer latch pin and the drawer is free to be pulled open.

In a second embodiment in the idle state all drawers remain locked. A drawer latch fixed to the frame may move into and out of engagement with an engagement formation fixed to the draw sufficiently to allow the drawer to be opened or held closed. The positions of the latch and engagement formation may be reversed.

The normal operation, for example, is that a user/staff member approaches the Master unit and uses their ID-Card to obtain service from the system by swiping or presenting their card to the card reader. An LCD display is used to communicate messages and instructions to the user. On swiping their ID-Card the system checks the system-wide database (or local database if the unit is operating in stand-alone mode) to verify the size required for that person. Once the size has been verified the Master unit instructs the user, via the LCD display, to open a particular drawer—e.g. "Please open drawer 4".

Once a user is instructed to open a particular drawer number, the unit may unlock the latch by energising a solenoid to pull a latch upwards, thus releasing the drawer pin. Once the latch is released the drawer can be pulled forward.

Once the drawer is pulled open, one of the storage section/compartment divisions may be uncovered (in the second mode) so as to allow access to the item(s) stored in that storage section/division.

Each storage section/compartment within the drawer may have a sliding cover such that it can slide back and forth to close or open a particular division. When slid back (second mode) it allows access to the storage section/compartment division, when slid forward (first mode) the storage section/compartment is closed preventing access.

Each cover may have a latch and an activating solenoid to control its locked and unlocked state. For example, a see-saw latch, which pivots around a pivot point, is used to lock the sliding cover in one of two extreme positions. When the drawer is closed, the latch is biased in a horizontal position by virtue of spring such that it engages with a lip on the back of the drawer. The fact the latch is hooked under the rear lip of the drawer means that once the drawer is pulled open the sliding cover on all compartments are held in the forward position (first mode). Thus, no user can attempt to manually push the sliding covers backwards to try and gain illegal access to closed storage section/compartments.

Once the system has decided which drawer and which storage section/compartment to open, the electronics will may first energise the solenoid on the selected storage section/compartment sliding cover such that the see-saw latch is pushed upwards by a solenoid, thus freeing the latch from the lip and instead engaging with the metal bracket on the cabinet frame. Thus, the sliding cover is now latched into the rear of the cabinet through a slot in bracket. Now when the drawer is pulled forward the sliding cover is restrained by latch thus providing access to the required storage section/compartment (second mode) as the drawer is fully opened. All other sliding covers remain latched in the (first mode) closed position and are unable to be forced open.

An opto-sensor may be used to register when the drawer is pulled open, and when it is pushed closed afterwards, such that the system can control the energising and de-energising of solenoids. Once the drawer latch is released, the user is able to pull the drawer open. As the drawer opens the opto-sensor signals that the drawer is now open, and at that point the drawer solenoid is then de-energised so that latch is de-energised and ready to re-clip over the drawer pin when the drawer is re-closed. The latch is able to flip back over the drawer pin and re-lock the drawer. When the drawer is sensed re-closed by the opto-sensor, the relevant energised latch solenoid(s) are also de-energised. Thus, the unit re-enters the idle state.

BRIEF DESCRIPTION OF THE DRAWINGS

For a better understanding of the present invention embodiments will now be described by way of example, with reference to the accompanying drawings, in which.

In the drawings like elements are generally designated with the same reference signs.

DETAILED DESCRIPTION OF EMBODIMENTS OF THE INVENTION

The embodiments of the invention now to be described provide a device for controlling the dispensing of items. In the embodiments to be described the items are items of clothing, and in particular "scrubs" which are worn by medics. However, it should be appreciated that the invention is applicable to the dispensing of many types of items. The embodiments are particularly advantageous for dispensing items, for example soft, formless or amorphous items, which do not have a fixed or rigid form, such as items formed of fabric, as such items tend to be more difficult to manipulate mechanically than items which have fixed form such as boxed items.

Figure 1:
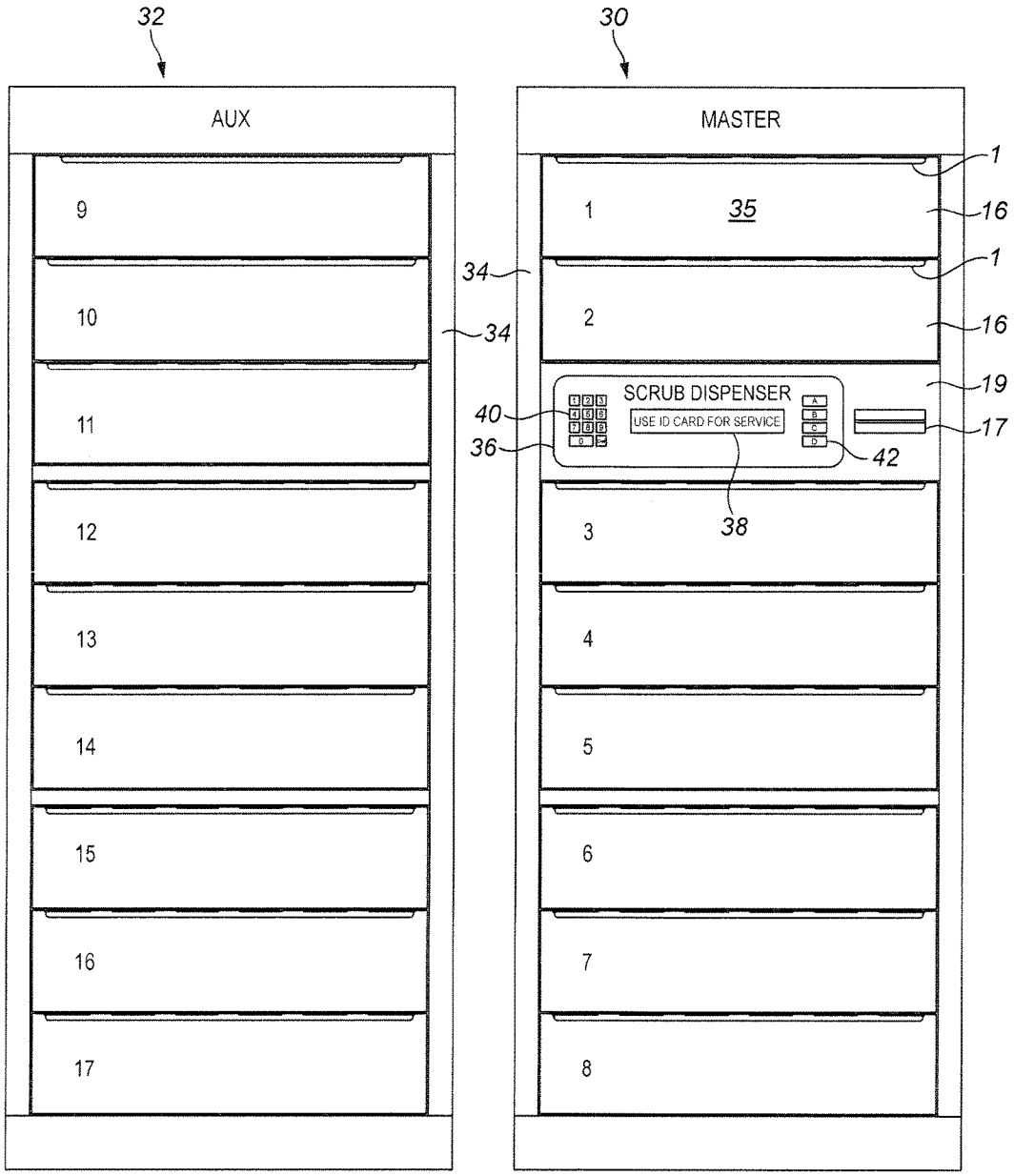
FIG. 1 shows a front plan view of a dispensing device according to an embodiment of the invention that includes a master unit and an auxiliary unit.

FIG. 1 shows a master dispensing unit 30 and an auxiliary dispensing unit 32. Each of the units 30, 32 includes a plurality of slidable drawers 16 which are slidably mounted to a frame 34. Each of the drawers 16 includes a front panel 35 from which a handle 1 extends to facilitate movement of the drawer 16 by a user. In the arrangement shown in FIG. 1 the master unit 30 includes eight drawers and the auxiliary unit 32 includes nine drawers. The drawers are marked with a number (1 to 17) for identification purposes. However, it should of course be understood that the number of drawers may be more or fewer according to the nature of and the number of items to be dispensed.

The master unit 30 includes one fewer drawers than the auxiliary unit 32 because one of the drawers is replaced by a control unit 36 comprising a control panel 19 and a card reader 17.

The control panel 19 includes a display 38, such as an LCD display. The control panel 19 includes a numeric keypad 40 and an alphabetic keypad 42 to allow the users to enter data. The card reader 17 includes a slot for receiving and reading an identity card provided to users of the system.

The identity card may be of the size and format similar to a credit card and may include a magnetic strip or electronic chip which stores information relating to the user, which the card reader 17 is configured to read. As an alternative to a card, other means for identifying a user may be used—such as biometric reading.

As will be described in more detail below, items are accessed by a user inserting their smart card into the card reader 17 of the master unit 30 in order to obtain items from the dispensing device. Using information read from the user's card, and any relevant information entered by the keypads 40,42, relevant items for the user will be dispensed from one of the drawers of the master unit 30 or auxiliary unit 32. The control unit 36 controls access to items within the drawers of both the master unit 30 and the auxiliary unit 32.

Figure 2:
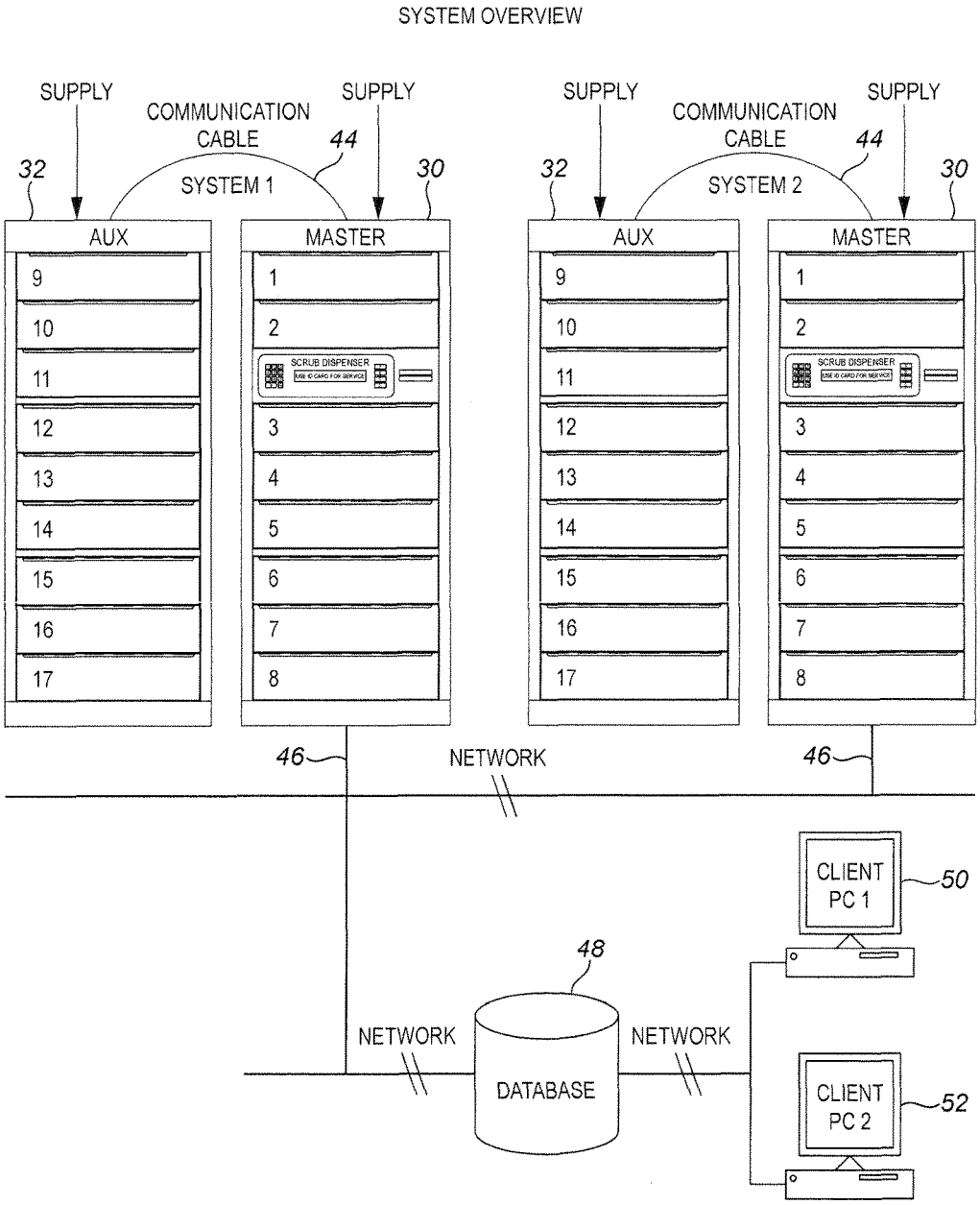
FIG. 2 shows schematically a system overview showing the communication connections between two sets of master and auxiliary units, and connections to a network and database.

Data to control access to the drawers of the auxiliary unit 32 is sent via communication cable 44 shown in FIG. 2 that connects the master unit 30 to the auxiliary unit 32. In FIG. 2, two master and auxiliary units are shown. Each of the master units 30 is connected by a network cable 46 to a database 48 which stores data relating to the users of the system and the item contents of the drawers. The database 48 can be accessed and manipulated by first and second data processing apparatuses (such as personal computers) 50 and 52.

It should be understood that, whilst in this example a communication cable 44 connects the master units 30 to the auxiliary units 32 and a network cable 46 connects the master units 30 to the database 48, these connections may be made by any suitable medium. For example, communication may completely or partially by wireless communication, such as Bluetooth, WiFi, cellular telecommunications, near field communication and the like. The connection between the master units 30 and the database 48 or/and the connections between the database 48 and the data processing apparatuses 50 and 52 may transmit data via the internet.

Figure 3:
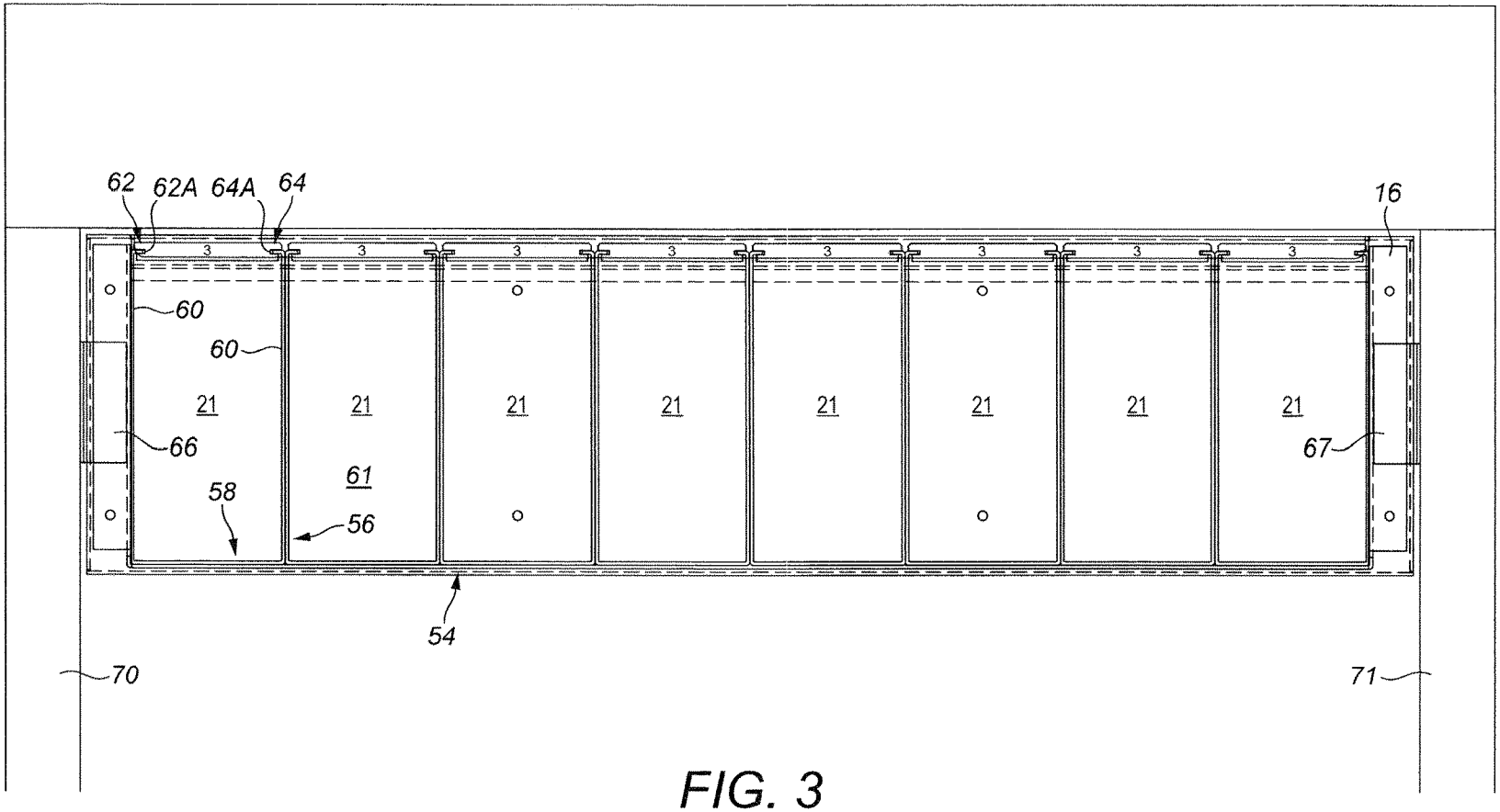
FIG. 3 shows a front view of a drawer of the dispensing device with the front panel of a drawer removed.

FIG. 3 shows a detailed front view of one of the drawers 16 from which the front panel 35 has been removed (which front panel 35 and the handle 1 thereof can be seen by dashed lines in FIG. 3). The drawer 16 includes a plurality of storage sections 21 which are supported by a drawer base 54. In FIG. 3 eight storage sections 21 are shown. The storage sections 21 are formed by dividing the volume of the drawer 16 with seven equally spaced dividing walls 56, although it should of course be appreciated that the dividing walls may not be equally spaced in order to provide a different sized storage section if required. Each of the storage sections 21 provides a storage volume bounded by the base 58 and a pair of oppositely facing side walls 60 which extend perpendicularly from the base 58. At the rear of each storage drawer 16 a rear panel 61 may be provided that extends between the drawer 16 side walls 66 and 67. A front wall may also be provided that extends between the front ends of the side wall 60*s*, or the front side may be provided by the front panel 35 of the drawer 16. The storage sections are thus defined by rigid walls and a rigid base.

At the top of each of the divider side wall 60 a flange 62 and 64 is formed which extends perpendicularly to the side wall 60. The flanges 62, 64 of the oppositely facing side walls extend towards one another. The flanges 62, 64 extend parallel to the base 58. The top of each storage section 21 is selectively closed or opened by a respective access panel 3. In this embodiment each of the access panels 3 has generally planar oppositely facing longitudinal side walls which include longitudinally extending recesses 62A and 64A shaped for receiving the flanges 62 and 64. The flanges 62, 64 and the recesses 62A, 64A cooperate such that the access panel 3 can slide relative to the associated storage section in a direction parallel to the base 58 of the storage section 21.

Figure 4:
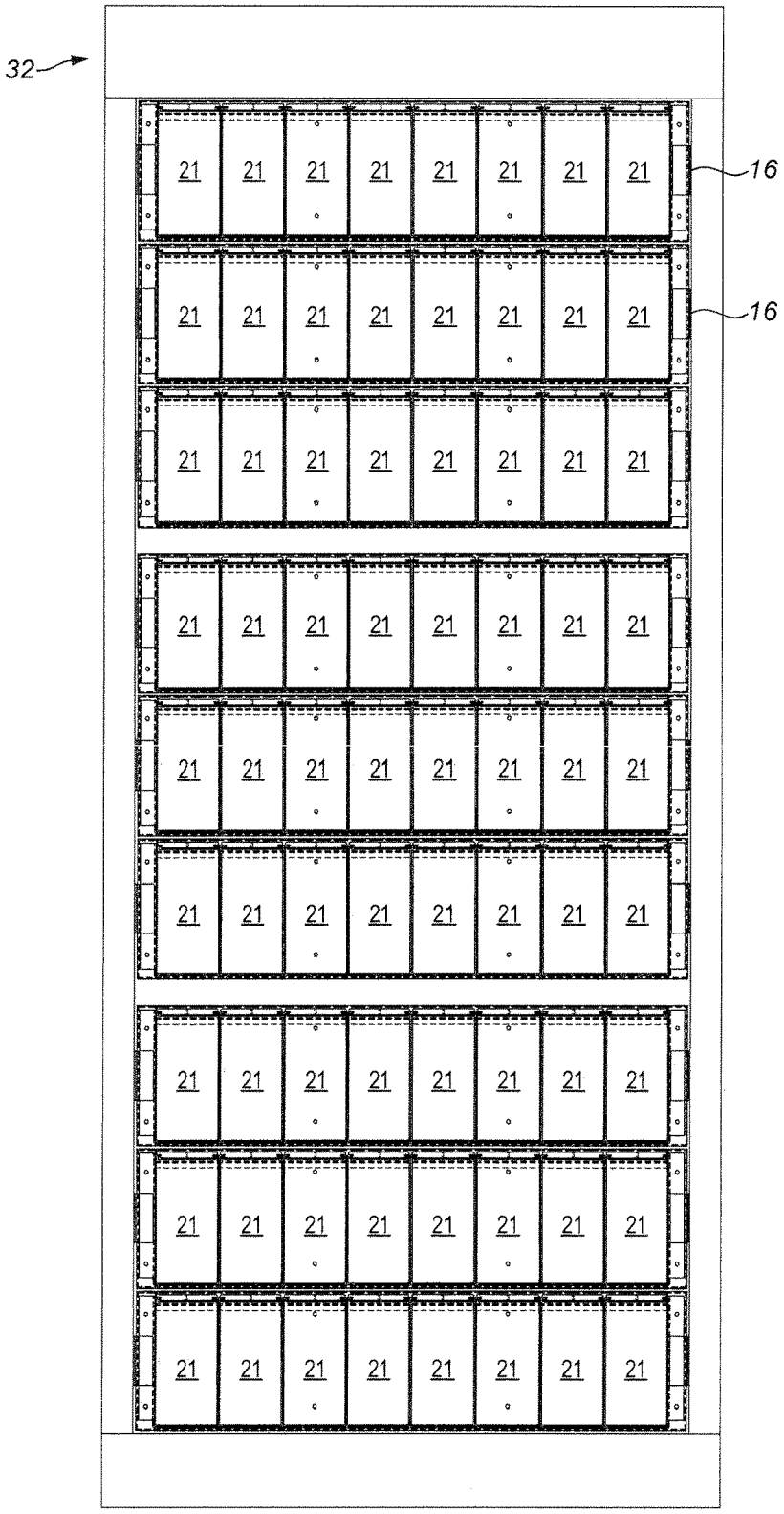
FIG. 4 shows a front view of the nine drawers of an auxiliary unit with the front panel of the drawers removed.

FIG. 4 shows an auxiliary unit 32 with each of the front panels 36 of the nine drawers 16 removed to reveal the eight storage sections 21 of each of the drawers 16.

The above features are common to the first and second embodiments of the invention.

Details particular to the first embodiment of the invention will now be described with reference to FIGS. 5 to 7.

Figure 5:
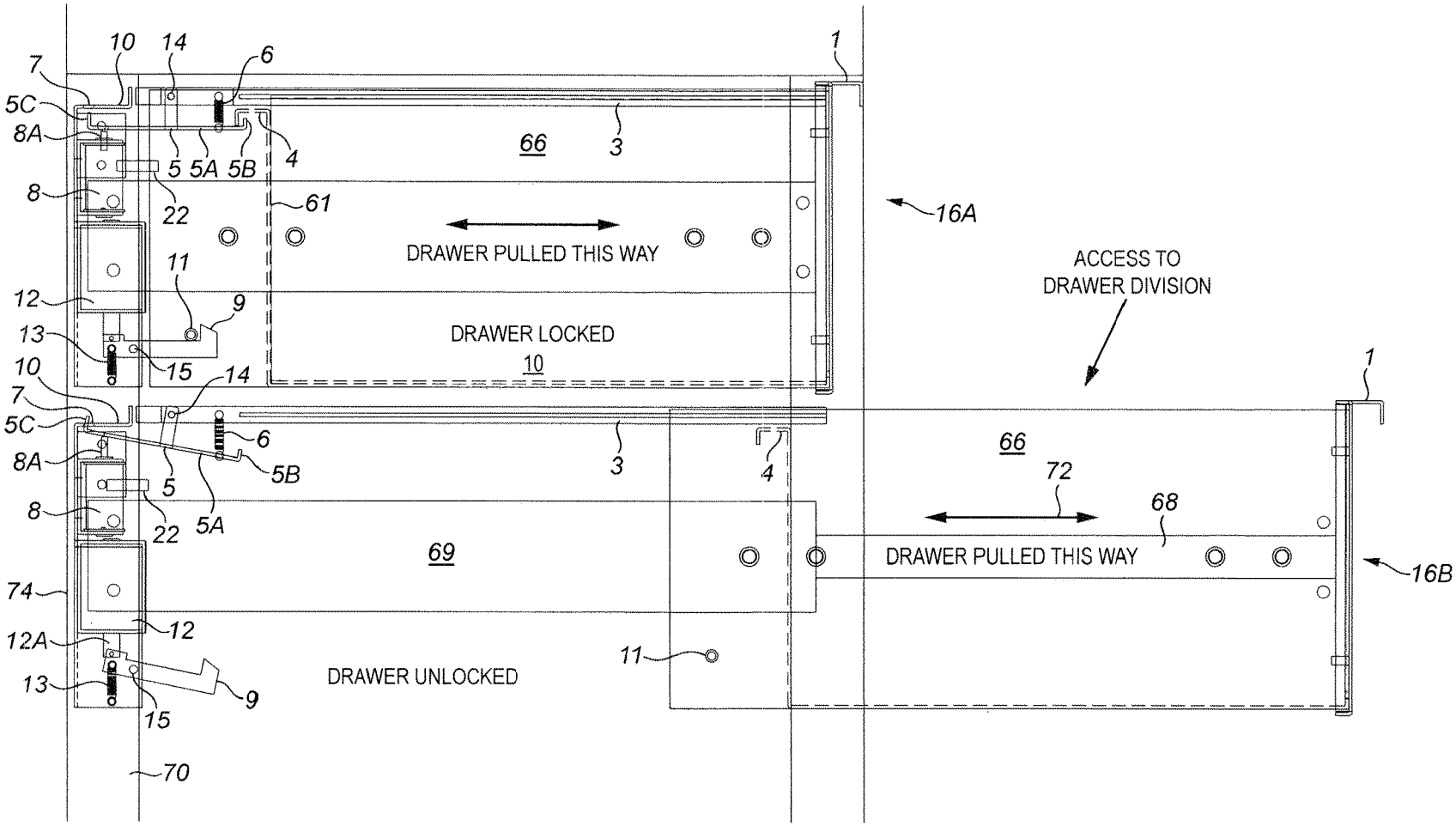
FIG. 5 shows a left side plan view of an upper and a lower drawer, with the lower drawer being opened in an item dispensing mode, according to a first embodiment of the invention.

Two adjacent drawers of one of the units 30, 32 are shown in more detail in FIG. 5 (an upper drawer 16A and a lower drawer 16B). Each of the drawers 16 has the same configuration as the drawers 16A, 16B of FIG. 5.

Each of the drawers 16 includes a left side panel 66 (and a right side panel 67 which cannot be seen in FIG. 5 of the drawings, but which corresponds in configuration to the left side panel 66). Mounted to each of the side panels 66, 67 is a slider 68 which extends longitudinally along the side panels 66,67. The slider 68 cooperates with a corresponding runner 69 formed on each of the left and right hand frame members 70, 71 (FIG. 3) of the frame 34 of the dispensing unit 30, 32. The slider 68 and runner 69 cooperate to allow opening and closing of the drawer by a sliding movement in the direction of arrow 72.

The frame 34 includes a rear member 74 to which various items may be attached to control movement of the drawer and the access panels 3.

A generally L-shaped drawer latch 9 is mounted to the left member 70 of the frame 34 by a pivot pin 15. A tension spring 13 is attached to a proximal end of the latch 9 at one end and to the left side member 70 at its other end. The spring 13 biases the latch 9 to rotate about the pivot pin 15 in an anti-clockwise direction so that the distal end of the latch 9 engages the drawer latch pin 11 as shown in the upper drawer 16A. A solenoid 12 is attached to the left side member 70 of the frame 34 and includes an actuator rod 12A which, on operation of the solenoid 12, moves linearly upwards into the solenoid body against the tension force of the spring 13 to cause rotation of the latch 9 in a clockwise direction about the pivot pin 15 so as to move the latch 9 out of engagement with the latch pin 11 sufficiently to allow the drawer to be opened as shown for drawer 16B of FIG. 5. The solenoid 12 is controlled by the control unit 36.

In the first embodiment, there is a drawer latch 9, a drawer latch pin 11, solenoid 12 and pivot point 15 on each side of each drawer 16 (left hand side and right hand side), although only the left hand side latch pin are shown in the drawings. These elements may be provided on only one side of the drawer in an alternative implementation.

A plurality of optical sensors 22 are coupled to the rear member 74 or left member 70 of the frame 34 and detect whether the drawer 16 associated therewith is open or closed. The control unit 36 receives a signal from the optical sensor 22 and interprets that signal to determine the open or closed state of the drawer 16. The signals from the optical sensor 22 of each drawer 16 are separately interpretable by the control unit 36 so that the control unit 36 knows which of the drawers are open and closed at any particular time. The signal from the optical sensor 22 is used to synchronise the operation of solenoids 12, 8. When the drawer is pulled open the optical sensor instructs the control unit 36 to de-energise solenoid 12 such that the latch 9 is ready to relock the drawer. Closing the drawer causes the optical sensor to signal that the drawer is closed and solenoid 8 can be de-energised.

Each of the access panels 3 of each of the drawers 16 has a see-saw latch 5 coupled to the rear end thereof at a pivot point 14. The see-saw latch 5 includes a main portion 5A having a front flange 5B at one end and a rear flange 5C at the opposite end. The see-saw latch 5 is biased by a tension spring 6 which at end one is connected to the main portion 5A of the see-saw latch 5 and at the other end to the access panel 3. The spring 6 biases the see-saw latch 5 to rotate about the pivot point 14 in an anti-clockwise direction so that its front flange 5B engages a lip 4 which extends from the rear panel 61 of the drawer 16. When the see-saw latch 5 is in this position the access panel 3 is mechanically coupled to the drawer 16 so that when the drawer 16 is moved, the access panel 3 moves with the drawer. Therefore, when the drawer 16 is opened, the access panel 3 opens with the drawer 16 and prevents access to the associated storage section 21.

An access panel solenoid 8 is mounted to the rear member 74 or the side member 70 and controls an actuator rod 8A. When the solenoid 8 is energised the actuator rod 8A moves out of the main body of the solenoid 8 and upward to cause the see-saw latch 5 to rotate against the force of the spring 6 about the pivot point 14 in a clockwise direction. The operation of solenoid 8 causes the latch to move to the position shown for the lower drawer 16B of FIG. 5. The front flange 5B of the latch 5 moves out of engagement with the lip 4 and into engagement with a slot 7 of a bracket 10 which extends from the rear member 74 or side member 70 of the frame 34. When the see-saw latch 5 is in the position shown for the lower drawer 16B of FIG. 5 the access panel 3 is mechanically coupled to the frame 34 and de-coupled from the drawer 16. Therefore, when the see-saw latch 5 is in this position, and the drawer 16 is moved, the access panel 3 does not move with the drawer 16 but instead stays fixed in position relative to the frame 34. Therefore, when the drawer 16 is opened the associated storage section 21 becomes accessible as the drawer 16 slides away from the access panel 3 (which is fixed to the frame 34).

Operation of the see-saw latch 5 solenoid 8 is controlled by the control unit 36.

Figure 6:
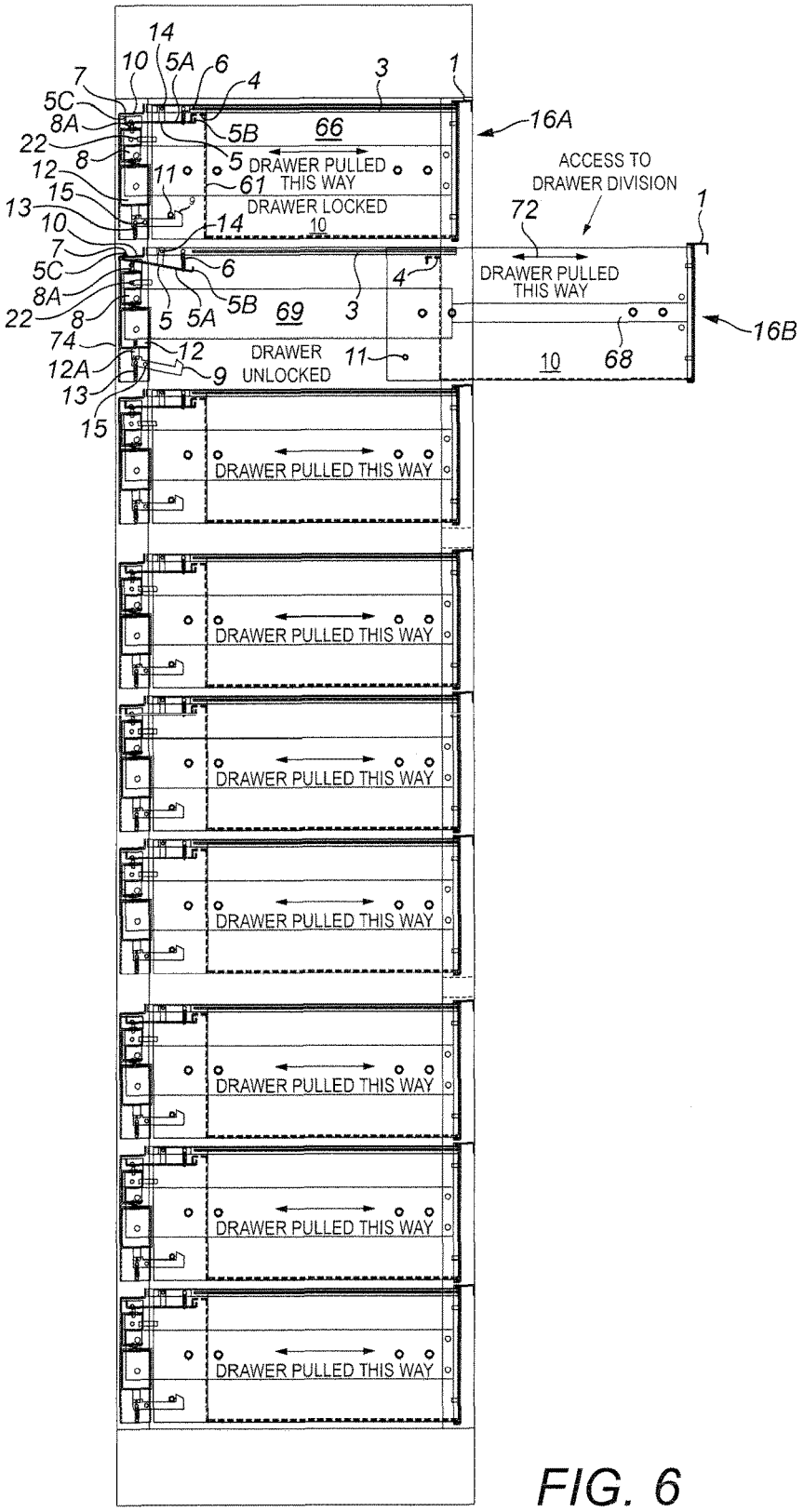
FIG. 6 shows a side plan view of nine drawers of an auxiliary unit which includes the upper lower drawers shown in FIG. 5, according to a first embodiment of the invention.
Figure 7:
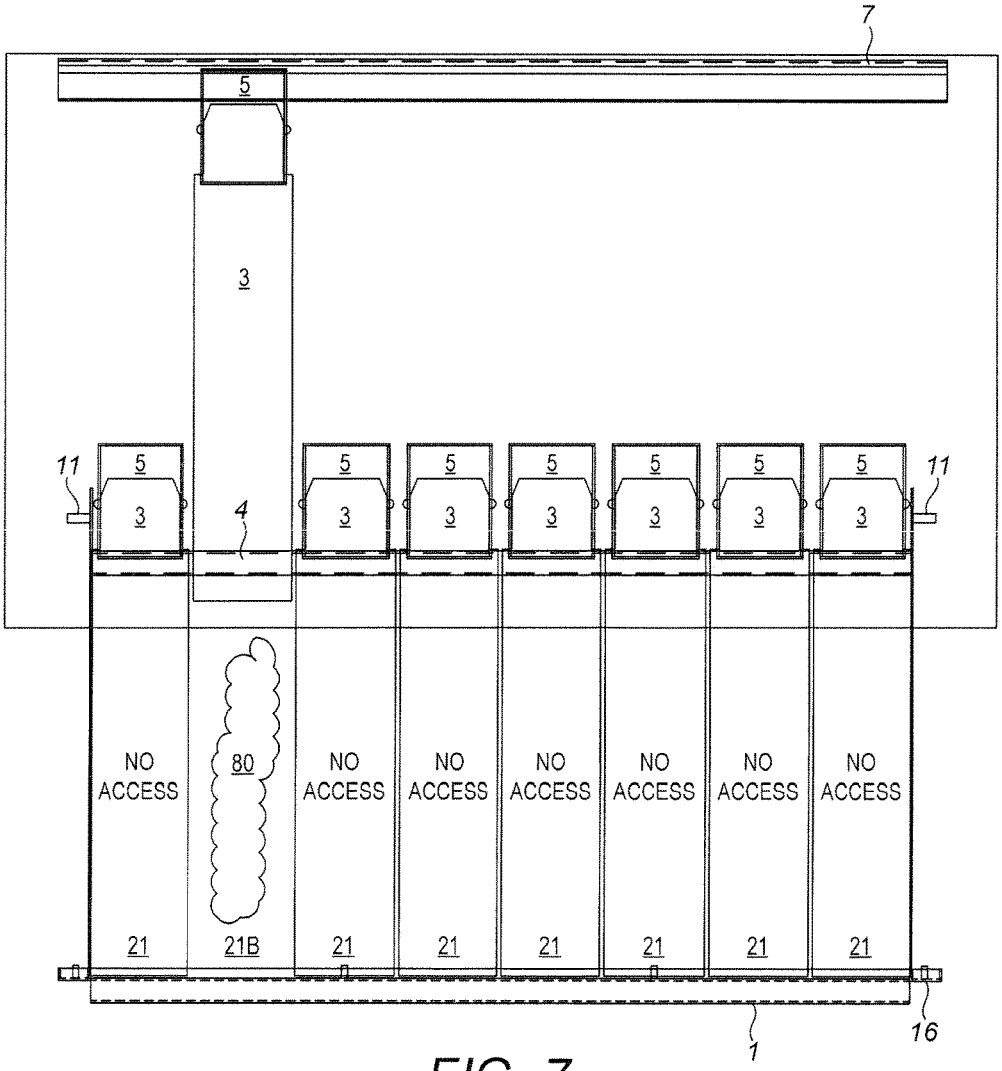
FIG. 7 shows an overhead view of a drawer in which the drawer is opened and one of the storage sections of that drawer is in an item (second mode) access mode, according to a first embodiment of the invention.

FIG. 6 shows a plurality of drawers in a unit (e.g. auxiliary unit 32 in FIG. 6) in which one drawer 16B is open. The solenoid 8 associated with a selected storage section 21B is actuated in the same way as in FIG. 5 and therefore the access panel 3 associated with the storage section 21B is mechanically coupled to the frame 34 so that, as the drawer is opened the storage section 21B of that drawer becomes accessible. This is illustrated in the overhead view of FIG. 7 of the drawer 16B which shows one of the eight storage sections 21B accessible due to operation of the solenoid 8 and the position of the see-saw latch 5 associated with the storage section 21B. The other storage sections 21 are not accessible because their associated solenoids 8 are not activated and so the related see-saw latches 5 have their position shown for drawer 16A in FIG. 5. The contents 80 of the storage section 21B can therefore be accessed and removed by the user. Significantly, due to the position of the other see-saw latches 5, a user of the system is not able to abuse the system and manually try to slide other access panels 3 forward manually by hand, thus trying to gain access to other closed divisions 21. The latch 5 prevents access to divisions 21 that are closed.

The operation of the device will now be described in more detail with reference to the drawings. For the purposes of this explanation it should be assumed that the device is stocked with the items to be dispensed. In this particular example the items to be dispensed are scrubs. One set of scrubs, comprising a top and bottom, are stored in each storage section 21 of each of the drawers 16. Different sizes of scrubs are provided to suit persons of different build. The size of the scrubs stored in each of the storage sections 21 are recorded in the database 48 by the data processing apparatus 50, 52 when the scrubs are loaded into each storage section 21. The device therefore contains a range of scrub sizes so that each user can obtain a size of scrub that is appropriate for them. The database 48 is aware of the storage section which stores each particular size of scrub.

Initially the device is an "idle" state and the display 38 of the control unit 36 displays a suitable message such as "swipe card" or "use id card for service".

In this idle state the drawer latch solenoid 12 and the see-saw latch solenoid 8 are de-energised so that the latch 9 engages the drawer latch pin 11 and the see-saw latch 5 engages the drawer lip 4—as shown for the upper drawer 16A in FIG. 5.

In the "idle state" a user cannot open any of the drawers 16 due to the engagement of the drawer latches 9 with the drawer latch pins 11.

In order for a user to obtain a set of scrubs from the device the user approaches the master unit 30 and swipes their ID card in the card reader 17. The card reader 17 reads the information on the ID card and transmits this to the control unit 36 in the master unit 30. The control unit 36 then consults the database 48. Information read from the card and the information from the database 48 allow the control unit 36 to determine in which storage section a suitable set of scrubs is located for that particular user.

The user's ID card may contain information identifying the user. That information is then used to look up in the database the appropriate size of scrubs for that particular user. Alternatively, the ID card may indicate the suitable size of scrubs for the user itself, and so consultation of the external database 48 is not required to identify the appropriate size of scrubs. The database 48 is therefore optional. Further, the database 48 may not be a remote database but instead there may be a local database provided locally to or within control unit 36 within the master unit 30.

In addition to storing data relating to the identity of the user and the size of their scrubs, a record may be kept of each time the user has obtained a set of scrubs. If the return of scrubs is also monitored, this allows the use of scrubs by a particular user to be audited and so it is likely to reduce the likelihood of scrubs not being returned. The issue of scrubs can then be authorised on a credit and debit basis.

When the control unit 36 identifies the storage section that stores the appropriate size of scrub for the user it causes the display 38 to display an appropriate message to open a particular drawer 16 within which the relevant storage section 21 is located. The message displayed may, for example, be "please open drawer 4".

The relevant solenoids 12 for the drawer are then energised by the control unit 36 and the drawer latches 9 are rotated in a clockwise direction about the pivot points 15 so that disengages the drawer latch pins 11 in a position shown for drawer 16B in FIG. 5. When the user grasps and pulls the handle 1 of the drawer 16 indicated to them by the display 38 the drawer slider 68 freely slides along the runner 69 of the frame 34.

The other drawers of the device cannot be opened by the user due to the action of the drawer latches 9 and drawer latch pins 11 of the other drawers. The control unit 36 also actuates the appropriate solenoid 8 for the relevant one of the see-saw latches 5 of that drawer which is associated with the storage section 21 which stores the appropriate size of scrubs for the user. For that storage section 21 the see-saw latch 5 moves to the position shown for the drawer 16B of FIG. 5. This mechanically couples the access panel 3 associated with the relevant storage section 21 to the bracket 10 of the frame 34 so that the access panel 3 is not moved with the relevant drawer 16 when it is opened by the user. Therefore, the relevant storage section 21 containing the size of scrubs 80 appropriate for the user can be accessed through the opening at the top of the relevant storage section 21 and the scrubs readily removed by the user. In FIG. 7 the storage section which contains the scrubs 80 for the user is the storage section labelled 21B.

The other storage sections of the drawer are not accessible because the solenoids 8 associated with those storage sections are not energised by the control unit 36. Hence the see-saw latches 5 remain in the position shown of the drawer 16A in FIG. 5 so that the access panel 3 of those storage sections 21 is coupled by the flange 5B and lip 4 to the drawer 16 and de-coupled from the bracket 10 of the frame 34, so that when the drawer is opened by the user the access panels 3 of the other storage sections move with the drawer thereby keeping the storage sections 21 closed off from access and abuse by the user, as shown in FIG. 7. When the drawer is open the engagement of the flange 5A of the see-saw latch with the lip 4 stops the user being able to manually push the access panel 3 backwards to try gain illegitimate access to the other storage sections 21.

The optical sensor 22 generates a signal indicative of the drawer 16 being opened and closed, and this signal is passed to the control unit 36. As the drawer is opened by the user the optical sensor 22 signals this to the controller 36, and at that point the control unit 36 de-energises the solenoids 12 so that the latches 9 returns to the position shown for the drawer 16A of FIG. 5 so that they are ready to clip over the latch pins 11 when the drawer is pushed closed by the user (after the user has taken the scrubs). As the drawer is closed by the user the oblique surface of the distal end of each latch 9 strikes the latch pin 11 and this temporarily causes the latch 9 to rotate in a clockwise direction about the pivot pin 15 until the latch pin 11 passes the oblique surface, whereafter the latch 9 resiles to a position shown for the drawer 16A of FIG. 5 to re-lock the drawer 16. When the signal from the optical sensor 22 indicates that the drawer has been closed, the control unit 36 then de-energies the solenoid 8 so that the see-saw latch 5 returns to the position shown of the drawer 16A of FIG. 5.

A system administrator or operator is provided with a special type of ID card (a master card) for use with the device. If the master card is swiped in the card reader 17 this is recognised by the control unit and the control unit enters an "operator mode" such that a number of management functions are made available. One of these management functions is a "clean" facility. In this mode the operator can open each drawer in turn to clean the storage sections 21 in that drawer 16. In this mode all the solenoids 8 for the drawer 16 are energised so that when the drawer is opened the access panels do not move with the drawer 16 so that all the storage sections 21 are accessible when the drawer is opened. This provides easy access for the operator to clean the storage sections.

Another option provided is a "refill" facility. For example, the device may be restocked once or twice a day. In the refill mode the operator is allowed to open each drawer 16 that requires refilling in turn. As the control unit 36 is aware of which storage sections 21 are empty the control unit 36 operates the solenoids 8 for the empty sections so that, when the drawer 16 is opened, those empty sections 21 are accessible to the operator for restocking (that is, the access panels 3 for those storage sections 21 are de-coupled from the drawers 16 and coupled to the frame 34). The control unit 36 may operate the display 38 to inform the loading operator sequentially what size items to store in each storage section 21. The operator uses the keypad 40, 42 to confirm to the control unit 36 that the items 80 have been re-loaded into the relevant storage sections 21 and then closes the drawer 16.

In the first embodiment described each drawer has two solenoids 12 and associated drawer latches 9 and drawer latch pins 11. Each drawer has eight solenoids 8 to lock/unlock each of the sliding access panels 3.

In an alternative arrangement, rather than providing each drawer with eight solenoids 8, one row of eight solenoids 8 may be provided in each of the units 30, 32 and a mechanism may be provided for moving this row of solenoids to the relevant drawer 16 that is to be opened to operate appropriately the see-saw latches 5 of that drawer. This may reduce costs by reducing the total number of solenoids required for each unit.

Additionally or alternatively, there may be only one pair of solenoids 12 for each unit 30, 32 and a mechanism may be provided for moving that pair of solenoids 12 to the relevant drawer 16 to operate the drawer latches 9 to allow opening of the drawer. This too reduces the number of solenoids required for each unit and may reduce costs.

Details particular to the second embodiment of the invention will now be described with reference to FIGS. 8 to 10.

Figure 8:
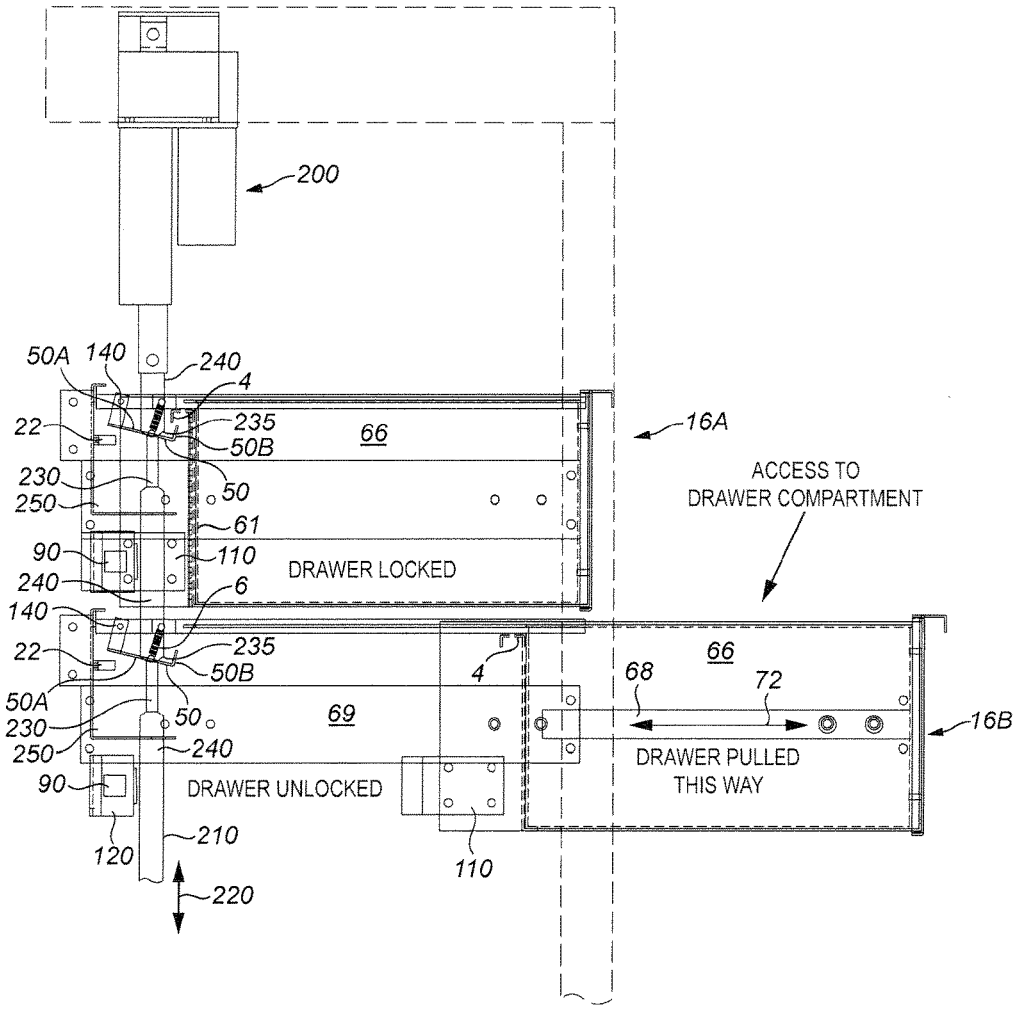
FIG. 8 shows a left side plan view of an upper and a lower drawer, with the lower drawer being opened in an item dispensing mode, according to a second embodiment of the invention.

Two adjacent drawers of one of the units 30, 32 (see FIGS. 1 to 4) are shown in more detail in FIG. 8 (an upper drawer 16A and a lower drawer 16B). Each of the drawers 16 has the same configuration as the drawers 16A, 16B of FIG. 8.

Each of the drawers 16 includes a left side panel 66 (and a right side panel 67 which cannot be seen in FIG. 8 of the drawings, but which corresponds in configuration to the left side panel 66). Mounted to each of the side panels 66, 67 is a slider 68 which extends longitudinally along the side panels 66,67. The slider 68 cooperates with a corresponding runner 69 formed on each of the left and right hand frame members 70, 71 (FIG. 3) of the frame 34 of the dispensing unit 30, 32. The slider 68 and runner 69 cooperate to allow opening and closing of the drawer by a sliding movement in the direction of arrow 72.

The frame 34 includes a rear member 74 to which various items may be attached to control movement of the drawer and the access panels 3.

Figure 10:
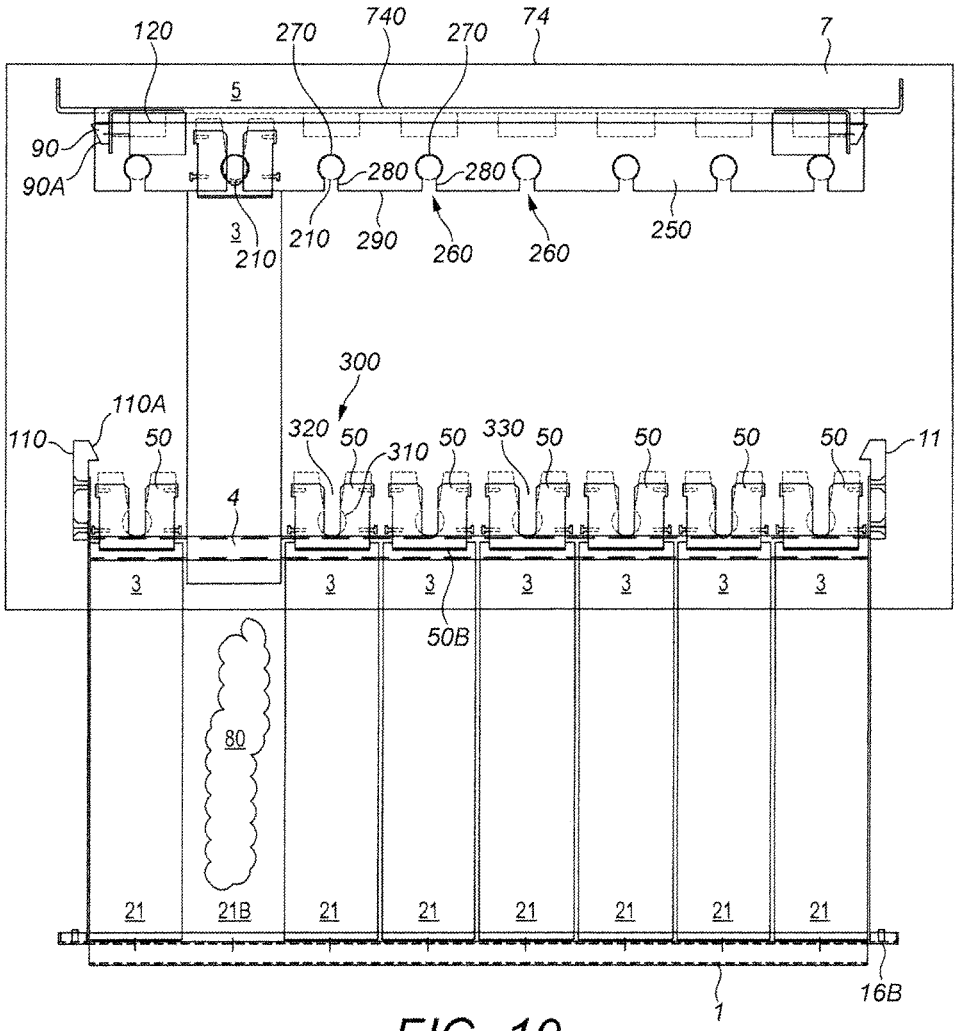
FIG. 10 shows an overhead view of a drawer in which the drawer is opened and one of the storage sections of that drawer is in an item (second mode) access mode, according to a second embodiment of the invention.

A generally L-shaped drawer latch 90 is mounted to the rear member 74 of the frame 34 near opposite edges thereof by a solenoid 120 attached to mount 740 (FIG. 10). The operation of the solenoid 120, moves the drawer latch 90 linearly in a direction parallel to the rear member 74 so as to move the latch 90 into and out of engagement with a latch arm 110 fixed to each side panel 66, 67 sufficiently to allow the drawer to be opened as shown for drawer 16B of FIG. 5. The solenoid 120 is controlled by the control unit 36.

In the second embodiment, there is a drawer latch 90, a drawer latch arm 110 and solenoid 120 on each side of each drawer 16 (left hand side and right hand side), although only the left hand side elements are shown in FIG. 8. These elements may be provided on only one side of the drawer in an alternative implementation.

A plurality of optical sensors 22 are coupled to the rear member 74 or left member 70 of the frame 34 and detect whether the drawer 16 associated therewith is open or closed. The control unit 36 receives a signal from the optical sensors 22 and interprets that signal to determine the open or closed state of the drawer 16. The signals from the optical sensor 22 of each drawer 16 are separately interpretable by the control unit 36 so that the control unit 36 knows which of the drawers are open and closed at any particular time. When the drawer is pulled open the optical sensor 22 instructs the control unit 36 to de-energise solenoid 120 so that drawer latch is in an extended position for engaging the latch arm 110 such that the latch arm 90 is ready to relock the drawer. Closing the drawer causes the optical sensor 22 to signal that the drawer is closed.

Each of the access panels 3 of each of the drawers 16 has an access panel latch 50 coupled to the rear end thereof at a pivot point 140. The latch 50 includes a main portion 50A having a front flange 50B. The latch 50 is biased by a tension spring 6 which at end one is connected to the main portion 50A of the latch 5 and at the other end to the access panel 3. The spring 6 biases the latch 5 to rotate about the pivot point 140 in an anti-clockwise direction so that its front flange 50B engages a lip 4 which extends from the rear panel 61 of the drawer 16. When the latch 50 is in this position the access panel 3 is mechanically coupled to the drawer 16 so that when the drawer 16 is moved, the access panel 3 moves with the drawer. Therefore, when the drawer 16 is opened, the access panel 3 opens with the drawer 16 and prevents access to the associated storage section 21.

A plurality of linear actuators 200 are provided above the stack of drawers (although the linear actuators could be provided below the stack of drawers in an alternative arrangement). Each linear actuator is operable to move a control rod 210 vertically in the direction of arrow 220. The rod 210 extends along the rear of each of the drawers 16 of the stack of drawers of the dispensing unit 30 (8 drawers in this example). In an alternative arrangement a separate linear actuator and rod may be provided for a subset of drawers of the dispensing unit. In the embodiment shown, a separate linear actuator 200 and rod 210 is provided for each group of vertically stacked storage sections 21. That is, a first linear actuator 200 and rod 210 is provided in associated with the left most storage section 21 of each of the drawers 16, a second linear actuator 200 and rod 210 is provided for the adjacent vertically stacked storage sections 21 of each of the drawers 16, etc, with an eighth linear actuator 200 and rod 210 being provided for each of the vertically stacked storage sections at the far right of the drawers 16 (FIG. 10).

Each of the rods 210 comprises a reduced diameter portion 230 corresponding to each of the drawers 16 which are connected together by larger diameter portions 240.

Behind each of the drawers 16 an L-shaped guide member 250 is mounted with respect to the rear member 74 of the frame 34. The guide member 250 includes 8 "keyhole" shaped recesses 260 formed therein provided at spaced apart positions corresponding to each of the 8 rods 210 (and storage sections 21). The recesses 260 comprise a larger diameter portion 270 sized to accommodate and guide the larger diameter portions 240 of the corresponding rod 210. A neck portion 280 extends between each of the generally circular larger diameter portions 270 and the distal edge 290 of the member 250. Optionally, the neck 280 may be omitted and the enlarged diameter portions 270 may be provided as generally circular apertures in the member 250.

Each of the access panels 3 includes at its rear end a "keyhole" shaped recess 300 (FIG. 10) comprising a generally circular enlarged diameter portion 310 which is connected to the rear end of the access panel 3 by a neck 320 that has a width that is less than the diameter of the enlarged diameter portion 310. The diameter of the enlarged diameter portion is such that the enlarged diameter portions 240 of the rod 210 can slide therethrough. The neck 320 has a width that is greater than the diameter of the reduced diameter portions 230 of the rod 210 but less than the diameter of the enlarged diameter portions 240 of the rod 210.

Each of the access panel latches 50 has a slot 330 formed in the main portion 50A thereof that opens at the end of the main portion 50A opposite to the front flange 50B. The slot 330 has a width such that only the reduced diameter sections 230 of the actuator rod 210 can pass therethrough (and the enlarged diameter portions 240 of the rods 210 cannot pass therethrough). The width of the slots 330 is greater than the diameter of the reduced diameter portions 230 of the rods 210 but less than the diameter of the enlarged diameter portions 240 of the rods 210.

When a drawer 16 is in the closed position the rods 210 of each of the linear actuators 200 pass through each of the slots 330 of the access panel latches 50 and each of the recesses 300 of each of the access panels 3 (and also through each of the recesses 260 in the guide member 250).

In FIG. 8 the rod 210 is shown in a lower, access panel unlocking portion. The rod is moveable from this lower, unlocking position to an access panel locking position in which the rod 210 is raised (linearly drawn upwards by the actuator 200). In the locking position of the rod 210 the reduced diameter portions 230 thereof are aligned with the recesses 300 of the associated access panels 3. In the locking position the reduced diameter portions 230 of the rod 210 also extend through (and above and below) each of the access panels latches 50 so that no force on the latches 50 is exerted by the rods 210, and the latches 50 are biased by the spring 6 to rotate about the pivot point 140 in an anti-clockwise direction so that their front flange 50B engages with the lip 4 which extends from the rear panel 61 of the draw 16 so that when the drawer 16 is moved, the access panel moves with the draw (and prevents access to the associated storage section 21).

In contrast, in the unlocking position (shown in FIG. 8), the shoulder 235 between the enlarged diameter portion 240 and reduced diameter portion 230 of the rod 210 is moved downwardly in the direction of arrow 220 and engages the upper surface of the access panel latches 50 rotating them clockwise about their pivot points 140 against the bias of the spring 6, thereby disengaging the flanges 50B from the lips 4 extending from the rear panel 61 of the drawers 16. This mechanically de-couples the drawer 16 from the associated access panel 3.

Further, when in the unlocking position, the enlarged diameter portion 240 of the rod 210 are vertically aligned with the recesses 300 of the access panels 3 such that the enlarged diameter portions 240 of the rods 210 occupy the enlarged diameter portions 310 of the recesses 300 of the access panels 3. In this position the access panel cannot slide horizontally with respect to the rod 210 because the enlarged diameter portion 240 of the rod 210 has a diameter greater than the width of the neck 320 of the recess 300 in the access panel 3. Therefore, in this position, if a drawer 16 is opened the access panel 3 associated with a rod 210 in the unlocking position will not move relative to the rod 210 (and the frame 34), and will therefore slide relative to the drawer 16 as the drawer 16 is opened, thereby allowing access to the associated storage section 21.

Operation of the linear actuators 200 is controlled by the control unit 36.

Figure 9:
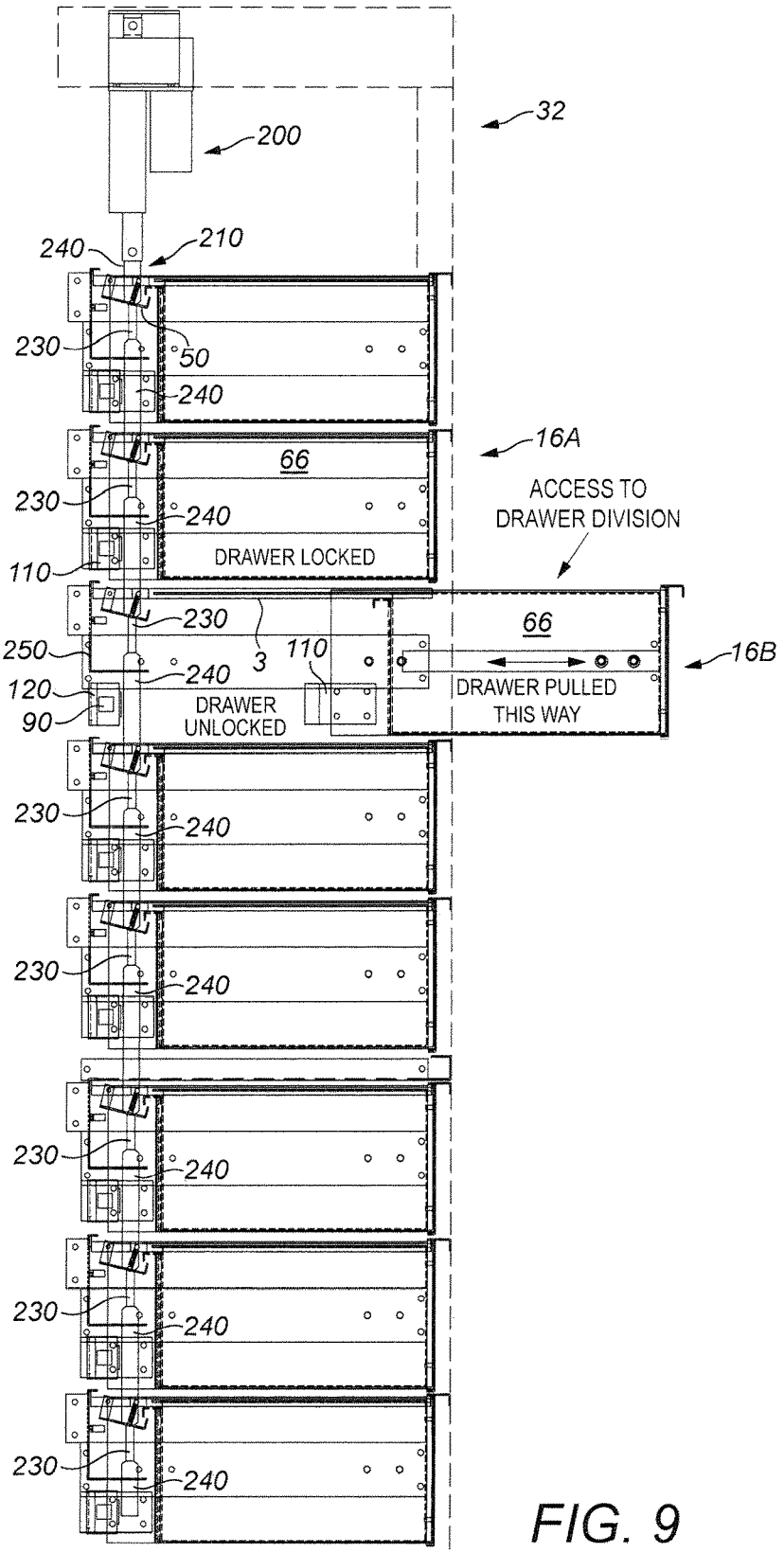
FIG. 9 shows a side plan view of nine drawers of an auxiliary unit (with 8 drawers) which includes the upper lower drawers shown in FIG. 8, according to a second embodiment of the invention.

FIG. 9 shows a plurality of drawers in a unit (e.g. 8 drawer auxiliary unit 32 in FIG. 9) in which one drawer 16B is open. The rod 210 associated with a selected storage section 21B is in the unlocking position in the same way as in FIG. 8 and therefore the access panel 3 associated with the storage section 21B is mechanically coupled to the rod 210 (and frame 34) so that, as the drawer 16 is opened the storage section 21B of that drawer becomes accessible. This is illustrated in the overhead view of FIG. 10 of the drawer 16B which shows one of the eight storage sections 21B accessible due to operation of the linear actuator 200 and the position of the rod 210 associated with the storage section 21B. The other storage sections 21 are not accessible because their linear actuators 200 are in the locking position. The contents 80 of the storage section 21B can therefore be accessed and removed by the user. Significantly, due to the position of the other rods 210, a user of the system is not able to abuse the system and manually try to slide other access panels 3 open manually by hand, thus trying to gain access to other closed divisions 21.

The operation of the device will now be described in more detail with reference to FIGS. 8 to 10 of the drawings. For the purposes of this explanation it should be assumed that the device is stocked with the items to be dispensed. In this particular example the items to be dispensed are scrubs, as in the first embodiment.

Initially the device is an "idle" state and the display 38 of the control unit 36 displays a suitable message such as "swipe card" or "use id card for service".

In this idle state the drawer latch solenoid 120 is de-energised so that the drawer latch 90 is in an extended position (extended from the position shown in FIG. 10) so that it engages with the latch arm 110 of the drawer 16 (the generally triangular head 110A of the latch arm 110 engages behind the generally triangular head 90A of the latch arm 90). This prevents the drawer 16 being opened. In this idle state the linear actuators 200 are de-energised so that the actuator rods 210 are in the locked position so that the access panel latches 50 engage the drawer lips 4 of each drawer 16.

In the "idle state" a user cannot open any of the drawers 16 due to the engagement of the drawer latches 90 with the drawer latch arms 110.

In order for a user to obtain a set of scrubs from the device the user approaches the master unit 30 and swipes their ID card in the card reader 17 and the control unit 36 determines in which storage section a suitable set of scrubs is located for that particular user, as in the first embodiment.

As in the first embodiment, when the control unit 36 identifies the storage section that stores the appropriate size of scrub for the user it causes the display 38 to display an appropriate message to open a particular drawer 16 within which the relevant storage section 21 is located. The message displayed may, for example, be "please open drawer 4".

The relevant drawer latch solenoids 120 are then energised by the control unit and the associated drawer latches 90 are withdrawn linearly within the solenoid bodies 120 (in the positions shown in FIG. 10) so that the drawer latches 90 disengage from the latch arms 110. When the user grasps and pulls the handle 1 of the drawer 16 indicated to them by the display 38 the drawer slider 68 freely slides along the runner 69 of the frame 34.

The other drawers of the device cannot be opened by the user due to the action of the drawer latches 90 and drawer latch arms 110 of the other drawers. The control unit 36 also actuates the appropriate linear actuator 200 for the relevant access panel latche 50 for that drawer which are associated with the storage section 21 which stores the appropriate size of scrubs for the user. For that storage section 21 (and the storage sections 21 stacked above and/or below) the latch 50 moves to the position shown for the drawer 16B of FIG. 8. This mechanically couples the access panel 3 associated with the relevant storage section 21 to the rod 210 (and the frame 34) and de-couples the latch 50 from the lip 4 of the drawer 16 so that the access panel 3 is not moved with the relevant drawer 16 when it is opened by the user as the enlarged diameter portions 240 of the rod cannot pass through the necks 320 of the recesses 300 of the access panels. Therefore, the relevant storage section 21 containing the size of scrubs 80 appropriate for the user can be accessed through the opening at the top of the relevant storage section 21 and the scrubs readily removed by the user. In FIG. 10 the storage section which contains the scrubs 80 for the user is the storage section labelled 21B.

The other storage sections of the drawer are not accessible because the linear actuators 200 associated with those storage sections are not energised by the control unit 36. Hence the latches 50 remain in the spring biased position so that the access panel 3 of those storage sections 21 is coupled by the flange 50B and lip 4 to the drawer 16, so that when the drawer is opened by the user the access panels 3 of the other storage sections move with the drawer thereby keeping the storage sections 21 closed off from access and abuse by the user, as shown in FIG. 10. As the relevant rods 210 are in the locked position the reduced diameter portions 230 are vertically aligned with the access panels 3 and so the rod 210 can pass through the necks 320 of the recesses 300. When the drawer is open the engagement of the flange 50A of the latch 50 with the lip 4 stops the user being able to manually push the access panel 3 backwards to try gain illegitimate access to the other storage sections 21.

When the rod 210 is in the locked position this vertically aligns the reduced diameter portions 230 of that rod with each of the access panels 3 of the sections stacked above and/or below the storage section 21 of the drawer 16 to be accessed, thereby potentially allowing the rod 210 to pass through the necks 320 of the recesses 300 of the access panels 3. However, the storage sections cannot be accessed because the drawers associated therewith remain locked due to the action of the relevant drawer latches 90 and drawer latch arms 110.

The optical sensor 22 generates a signal indicative of the drawer 16 being opened and closed, and this signal is passed to the control unit 36. As the drawer is opened by the user the optical sensor 22 signals this to the controller 36, and at that point the control unit 36 de-energises the relevant solenoids 120 so that the latches 90 return to the locking position of so that they are ready to engage the latch arms 110 when the drawer is pushed closed by the user (after the user has taken the scrubs). As the drawer is closed by the user the oblique surface of the triangular 110A end of each latch arm 110 strikes the latch 90 and this temporarily causes the latch arm 110 to flex outwardly until the latch arm 110 passes the triangular head 90A of the latch 90, whereafter the latch arm 110 resiles to a position shown in FIG. 10 to re-lock the drawer 16. When the signal from the optical sensor 22 indicates that the drawer has been closed, the control unit 36 then de-energies the linear actuator 200 so that the rod 210 returns to the locked position.

As in the first embodiment, a system administrator or operator is provided with a special type of ID card (a master card) for use with the device. If the master card is swiped in the card reader 17 this is recognised by the control unit and the control unit enters an "operator mode" such that a number of management functions are made available. One of these management functions is a "clean" facility. In this mode the operator can open each drawer in turn to clean the storage sections 21 in that drawer 16. In this mode all the linear actuators 200 and the solenoids for the drawer 16 are energised so that when the drawer is opened the access panels do not move with the drawer 16 so that all the storage sections 21 are accessible when the drawer is opened. This provides easy access for the operator to clean the storage sections.

Another option provided is a "refill" facility. For example, the device may be restocked once or twice a day. In the refill mode the operator is allowed to open each drawer 16 that requires refilling in turn. As the control unit 36 is aware of which storage sections 21 are empty the control unit 36 operates the linear actuators 200 and the solenoids for the empty sections so that, when the drawer 16 is opened, those empty sections 21 are accessible to the operator for restocking (that is, the access panels 3 for those storage sections 21 are de-coupled from the drawers 16 and coupled to the frame 34). The control unit 36 may operate the display 38 to inform the loading operator sequentially what size items to store in each storage section 21. The operator uses the keypad 40, 42 to confirm to the control unit 36 that the items 80 have been re-loaded into the relevant storage sections 21 and then closes the drawer 16.

The access panels 3 of the first and second embodiments are typically manufactured from nylon or see-through plastic so the users and operators can easily see the contents of the storage sections 21.

The system may further include a unit to which the dispensed items 80 are returned. Such a returning unit is not shown in the drawings but may include a control unit and a card reader. The user swipes their card in the card reader to identify themselves and then deposits the returned items (scrubs in this example) in an appropriate receptacle. The returning of the items is recorded by the control unit 36 and the database 48 is updated as appropriate. In this way a record of the number of items held by a user at any particular time can be maintained. If required a credit and debit facility can be programmed in to the control unit 36 to only allow the user access to a fixed number of scrub sets before they have to deposit sets to obtain further credit.

Although in the embodiment described each master unit 30 has a single auxiliary unit associated therewith, the master unit 30 may be provided with no auxiliary units or a plurality of auxiliary units 32 depending on the circumstances and required storage capacity.

The invention claimed is:

1. A device for controlling dispensing of items, comprising:

a frame;

at least one drawer slidably mounted for movement with respect to the frame, the drawer having a plurality of storage sections;

a plurality of access panels, each associated with one of the storage sections and mounted for sliding movement relative to the associated drawer;

control means for controlling the sliding movement of each of the access panels relative to the associated drawer so that, when the drawer is opened, the access panel is either in a first mode which prevents access to its associated storage section or in a second mode which allows access to its associated storage section;

coupling means associable with each of said access panels and comprising a linearly reciprocating member operable in a first position to couple the access panel to the frame by engagement of the linearly reciprocating member with the access panel so that when the drawer is opened movement of the access panel is constrained by the coupling means and the access panel enters the second mode allowing access to the storage section by the sliding movement relative to the associated drawer; and latch means operable in a first latch position to facilitate the sliding movement of the drawer relative to the access panel, wherein the latch means comprises a latch member coupled to the access panel at a pivot point and moveable into the first latch position by the linearly reciprocating member.

2. The device of claim 1, wherein each storage section comprises a base and a plurality of walls surrounding the base, the storage section accessed through a top opening.

3. The device of claim 1, including locking means operable to selectively allow the drawer to be opened.

4. The device of claim 1, wherein the drawer is arranged for manual movement by a user.

5. The device of claim 1, wherein the coupling means is operable in a second position to de-couple the access panel from the frame so that when the drawer is opened the access panel in the first mode moves with the drawer so preventing access to the storage section.

6. The device of claim 1, wherein the latch means is operable in a second position to couple the access panel to the drawer.

7. The device of claim 1, wherein the control means is operable to retrieve data relating to a characteristic of item stored in each of the storage sections.

8. The device of claim 7, wherein the control means is operable to receive data relating to an item required to be dispensed, to identify in which of the storage sections such an item is stored and to operate the access panel of the storage section containing that item in the second mode to allow access to that item.

9. The device of claim 1, in combination with an auxiliary device which includes a frame, at least one drawer having a plurality of storage sections, and a plurality of access panels, wherein the control means controls the movement of each of the access panels of the auxiliary device.

10. A device for controlling dispensing of items, comprising:

a frame;

at least one drawer slidably mounted for movement with respect to the frame, the drawer having a plurality of storage sections;

a plurality of access panels, each associated with one of the storage sections;

and mounted for sliding movement relative to the associated drawer;

a controller for controlling the sliding movement of each of the access panels relative to the associated drawer, such that when the drawer is opened, an access panel is opened allowing access to its associated storage section and a different access panel is closed thereby prevents access to its associated storage section;

a coupler associable with each of said access panels and comprising a linearly reciprocating member operable in a first position to couple the access panel to the frame by engagement of the linearly reciprocating member with the access panel so that when the drawer is opened movement of the access panel is constrained by the coupler and the access panel allows access to the storage section by the sliding movement relative to the associated drawer; and a latch operable in a first latch position to facilitate the sliding movement of the drawer relative to the access panel, wherein the latch comprises a latch member coupled to the access panel at a pivot point and moveable into the first latch position by the linearly reciprocating member.

* * * * *